US005893630A

United States Patent [19]

Mosquera

[11] Patent Number: 5,893,630

[45] Date of Patent: Apr. 13, 1999

[54] FLASHLIGHT HOLDING AND POSITIONING DEVICE

[76] Inventor: Eddie Frank Mosquera, 1607 W. Weathersfield Way, Schaumburg, Ill. 60193

[21] Appl. No.: 08/799,154

[22] Filed: Feb. 14, 1997

[51] Int. Cl.[6] ..... F21V 21/00

[52] U.S. Cl. ..... 362/191; 362/190; 362/418; 362/398

[58] Field of Search ..... 362/190, 191, 362/413, 418, 287, 398

[56] References Cited

U.S. PATENT DOCUMENTS

| | | | |
|---|---|---|---|
| 4,376,965 | 3/1983 | Bacevius | 362/191 |
| 4,506,317 | 3/1985 | Duddy | 362/396 |
| 4,974,139 | 11/1990 | Chin-Song | 362/418 |
| 5,163,752 | 11/1992 | Copeland et al. | 362/191 |
| 5,222,806 | 6/1993 | Roberts, III | 362/401 |
| 5,460,346 | 10/1995 | Hirsch | 362/191 |

*Primary Examiner*—Thomas M. Sember
*Attorney, Agent, or Firm*—Steven M. Shape; Steven M. Shape & Assocs.

[57] ABSTRACT

A flashlight holding and positioning device is provided which includes a base member for independently supporting the device, an arm which pivots with respect to the base and includes means for securing the flashlight to the arm and a means for maintaining the relative position of the arm with respect to the base. The arm is pivotable with respect to the base for purposes of positioning the beam of the flashlight on a specific work area without the need for the user to hold the flashlight.

12 Claims, 3 Drawing Sheets

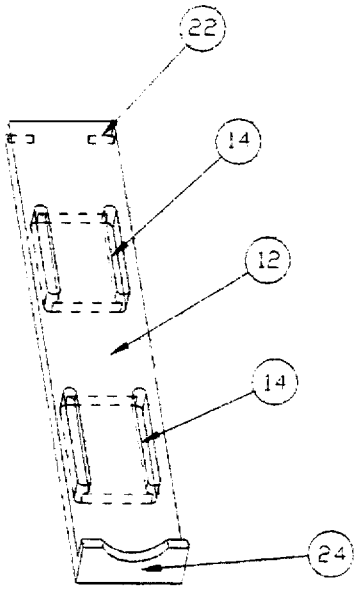
FIGURE 4
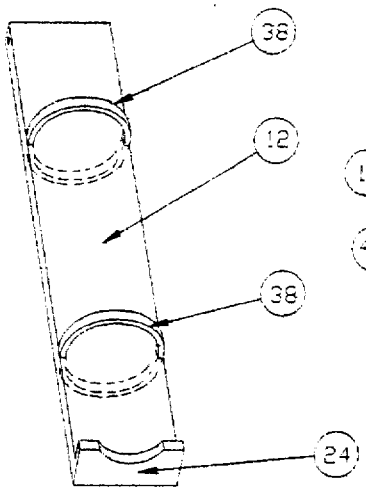
FIGURE 5
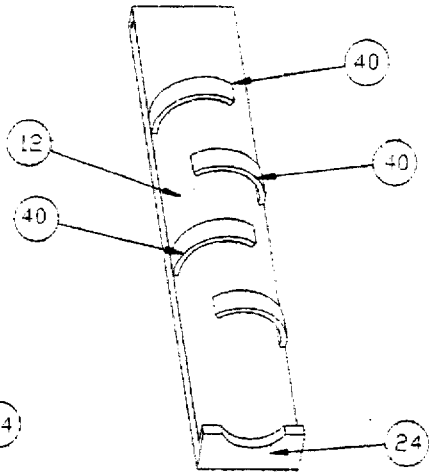
FIGURE 6
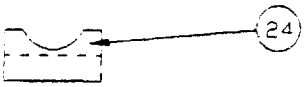

FLASHLIGHT HOLDING AND POSITIONING DEVICE

BACKGROUND OF THE INVENTION

One of the most perplexing and difficult problems to solve in working with one's hands in a repair environment is supporting and positioning light adequately upon the repair area. It is desirable to have both hands free under most circumstances for purposes of manipulation of one's hands and tools held therein when making repairs in an area with limited ambient light. In order to solve this problem, some individuals would choose to hold a flashlight in one hand or in their mouth while shining it in a desired direction on an area of repair. This method is quite uncomfortable and cannot be sustained for long periods of time, particularly when both hands are necessary to complete the repair. Another solution may be to hold the flashlight between one's arm and the side of their chest for purposes of providing light to the repair area. This approach is awkward, since the user cannot relax his arm for fear that the flashlight might fall to the ground.

People have tried to solve this dilemma using various apparatuses which are supported by magnetic base members or various portions of one's body. U.S. Pat. No. 5,506,317 to Duddy illustrates a support for a flashlight with a magnetic base for use in repairing motor vehicles. A c-shaped resilient clamp supports a battery-operated flashlight that is connected to a magnetic base having an elongated arm with means for swiveling the support with respect to the base. Such construction is complicated, requires a metallic iron containing object to support the magnetic base and is generally difficult to properly position and secure in a limited working environment. U.S. Pat. Nos. 5,413,545 and 5,379,491 to Rising and Solo, respectively, provide means for holding flashlights to parts of a person's body, specifically their head or hips. These prior devices make use of hook and eye type fasteners, which may be mounted on a pivoting member for securing to one's head, hip or arm. Such devices are not supportable on their own and are generally not height adjustable. Furthermore, these devices are difficult and cumbersome in appropriately securing a battery-operated flashlight for precise adjustability and positioning in a limited work environment.

SUMMARY OF THE INVENTION

It is an object of the present invention to provide a flashlight holding and positioning device which is simple in construction, supportable on its own, without need to secure the device to a member to form a supporting base. It is a further object of the invention to provide means to pivot the flashlight holding member with respect to a base which need not be secured to any other member for its support. Furthermore, it is desirable to provide a flashlight holding and positioning device which may be adjustable in height for positioning the beam of the flashlight on a specific work area. It is yet another object of the invention to provide a method by which the flashlight can be easily secured to an arm which pivots with respect to a base member. Details of the foregoing objects of the invention, as well as other objects thereof, are set forth in the following specification and illustrated in the accompanying drawings comprising a part thereof.

BRIEF DESCRIPTION OF THE DRAWINGS

FIG. 4 shows a plan view of the arm illustrating the adjusting slots which help position the flashlight therein;

FIG. 5 is a perspective view of the flashlight holding and positioning device arm illustrating restraining bands which maintain and position the flashlight thereon;

FIG. 6 is a second embodiment illustrating the use of restraining fingers on the arm to secure the flashlight to the arm;

DETAILED DESCRIPTION OF THE INVENTION

Figure 1:
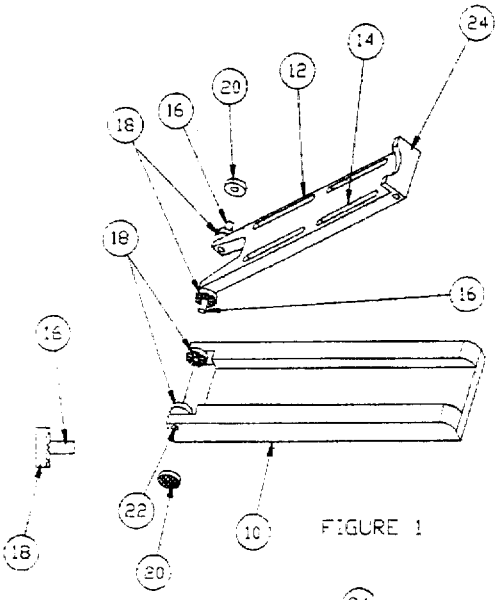
FIG. 1 is an exploded perspective view of the flashlight holding and positioning device showing the arm removed from the base member and illustrating a detent mechanism for securely positioning the arm with respect to the base member.

Referring to the drawings, the flashlight holding and positioning device includes a base member 10 for independently supporting and holding the structure to which a flashlight is mounted as illustrated in FIG. 1. Base member 10 is shaped such that it acts as the sole support and stand for the device and does not require any additional supporting member or attachment. The device includes an arm 12 which pivots with respect to the base 10 and includes at least one slot 14 formed in arm 12 which accepts securing members, such as hook and eye type straps or the like, for securing a flashlight to arm 12. The embodiment illustrated in FIG. 1 includes a detent mechanism whereby the arm 12 includes pins 16 which are positioned in apertures 22 for pivotal movement of arm 12 with respect to base 10. In addition, arm 12 includes a detent mechanism which includes cooperating male detent member 18 and female detent member 20. When pins 16 are positioned in apertures 22, the male detent member 18 nests with the female detent member 22 and allows arm 12 to be securely positioned relative to base 10 providing full adjustability of the height of the flashlight secured to arm 12.

Figure 2:
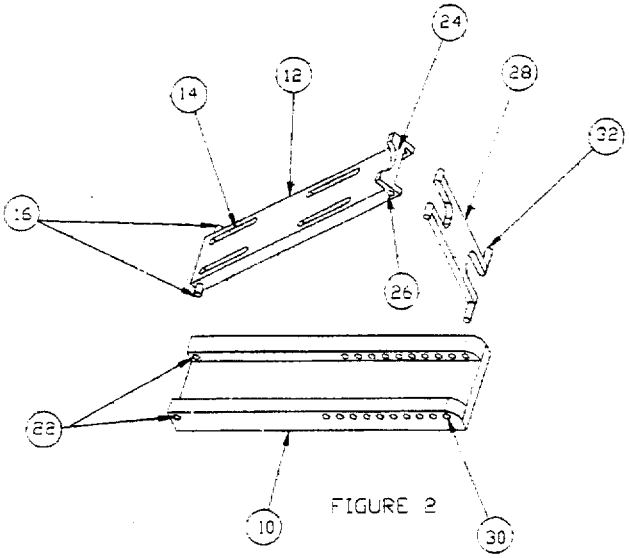
FIG. 2 is an exploded perspective view of the flashlight holding and positioning device showing the arm broken away from the base member and further illustrating a group of adjusting apertures and pins for positioning the arm with respect to the base member.

FIG. 2 illustrates another method by which arm 12 may be positioned with respect to base 10. Base 10 includes a plurality of apertures 30 which allow for the relative adjustment of pins 32 which are positioned at one end of an adjusting member 28. Adjusting member 28 is pivotable at pivot point 26 with respect to arm 12. This pivotal movement allows adjusting pins 32 to be positioned in one of the sets of apertures in base 10 for relative positioning of arm 12 with respect to base 10.

Figure 3:
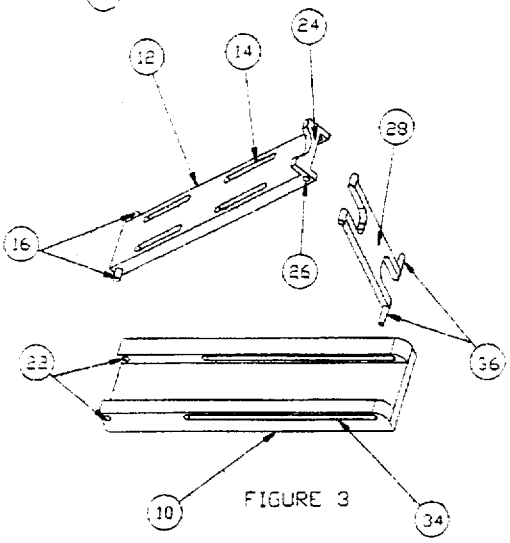
FIG. 3 is an exploded perspective view of the flashlight holding and positioning device showing the arm broken away from the base member and illustrating coated feet which cooperate with an adjusting slot for positioning the arm relative to the base member.

FIG. 3 illustrates yet another method by which arm 12 is adjusted with respect to base 10. In this embodiment, base 10 includes an adjusting slot 34 which accepts at least one coated foot 36 therein. Adjusting member 28 is also pivotable at pivot point 26 with respect to arm 12. Arm 12 if pivotable with respect to base 10 around pins 16, which are received in apertures 22. In addition, adjusting member 28 pivots with respect to arm 12 at pivot point 26, thereby allowing arm 12 to be relatively positioned with respect to base 10 at an infinite number of vertical heights and angles relative to base 10. Arm 12 also includes cradle 24 which forms a rest for the head of the flashlight which is positioned on arm 12 for use.

As can be seen in FIG. 4, arm 12 includes at least one slot 14 which is positioned to receive one or more bands which may include hook and eye closures thereon for purposes of receiving, retaining and otherwise securing a flashlight to arm 12. As shown, the head of the flashlight would typically rest in cradle 24 for purposes of maintaining its position for use in a work environment.

FIGS. 5 and 6 illustrate various retention members which secure and retain a flashlight to arm 12 while holding the head of the flashlight in cradle 24 for relative positioning of the beam of the flashlight on a work area. As can be seen, these retaining members include a restraining band 38 or staggered restraining fingers 40 which are positioned on or form part of arm 12. It may be appreciated by those skilled in the art that the number of restraints may vary depending on the length of arm 12 and the size of the flashlight which will be positioned for use on arm 12. It may also be appreciated that restraints such as restraining band 38 and restraining fingers 40 may vary in width, thickness and type of material for purposes of properly securing a flashlight to arm 12.

It should also be appreciated by those skilled in the art that the flashlight holding and positioning device of the present invention may be formed of plastic or a plastic composite material, metal or other solid material, depending on the environment in which the device will be used. In addition, a magnetic member may be positioned under base 10 for securing the flashlight holding and positioning device to a metallic or iron containing object.

Figure 7:
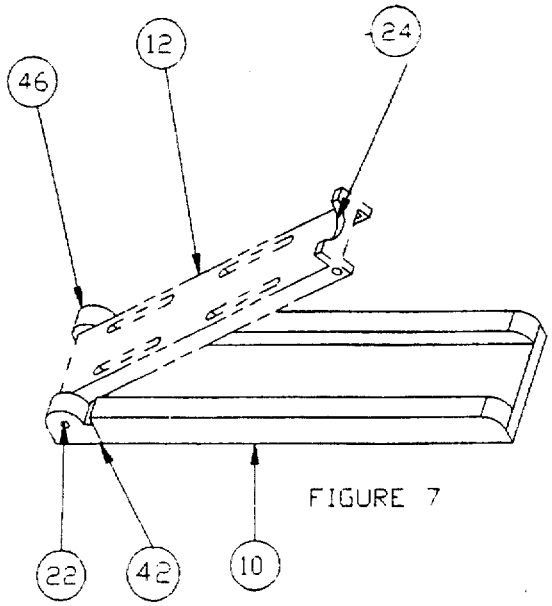
FIG. 7 is a perspective view of the base member showing the arm in phantom line.
Figure 8:
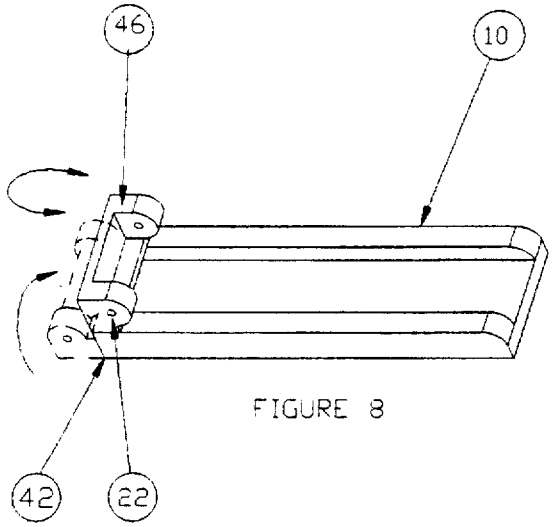
FIG. 8 is a perspective view of the base member showing adjustability of the mounting member of the base member with apertures forming the pivot point of the arm.
Figure 9:
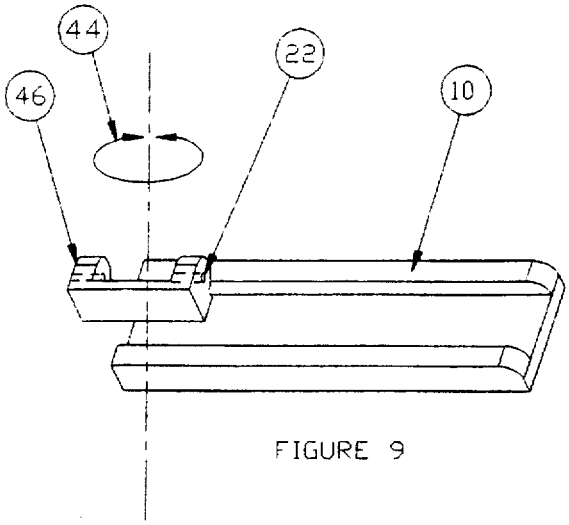
FIG. 9 is a perspective view of the base member showing the rotation of the mounting portion of the base member.

FIGS. 7, 8 and 9 illustrate the use of an adjustable connecting member 46 which is movable, pivotable and may be swiveled with respect to base 10. Connecting member 46 may be pivotable with respect to base 10 such that connecting member 46 may be positioned on top of base 10. After such positioning on top of base 10, connecting member 46 can be swiveled around swivel point 44 so that the connecting member 46 rotates about an axis perpendicular to base 10. This type of pivoting and swiveling movement of connecting member 46 allows the relative positioning of the connecting member 46 with respect to arm 12. Such combination allows the light beam of the flashlight to be precisely and accurately positioned in a tight work environment.

In use, the operator of the flashlight holding and positioning device can select the desired angle of a beam of light from a flashlight which is positioned on arm 12 by separating arm 12 from base 10. The relative angle of position of arm 12 with respect to base 10 may be 0 to 180 degrees. When the unit is not in use it may be folded shut for ease of storage.

Specifically, base 10 may be folded into alignment with arm 12 to close the device for compacting the device for storage. As can be seen in FIGS. 1, 2, 3 and 7, a design of the holding and positioning device of the present invention provides for precise alignment and registration of base 10 and arm 12, allowing the device to fold into itself, which contributes to its compact storage configuration and ease of use.

It may be appreciated by those skilled in the art that the detent means shown in FIG. 1 may also include a gearing mechanism for purposes of adjustably positioning arm 12 with respect to base 10. Such a gearing mechanism may include a sealed and self-lubricating gearing member with appropriate detent adjustability. In addition, the coated feet 36 illustrated in FIG. 3 may be coated with a wide variety of materials to provide friction between the coated foot 36 and adjusting slots 34. Arm 12 may be formed in various styles including a wire-base member or including various protrusions or channel members to provide added stability for various sized flashlights secured to arm 12.

The foregoing description illustrates the preferred embodiments of the invention. Numerous alterations of the structure disclosed herein will suggest themselves to those skilled in the art. It is to be understood that the present disclosure relates to the preferred embodiments of the invention which are for purposes of illustration only, and are not to be construed as limitations of the invention. The following claims are intended to protect the invention broadly, as well as in the specific forms shown herein.

What is claimed is:

1. A flashlight holding and positioning device comprising:

a) a base member which forms a platform for independently supporting the holding and positioning device;

b) an arm connected to said base including means for securing a flashlight to said arm; and c) means for maintaining the relative position of said arm with respect to said base member including means for pivoting said arm with respect to said base member and associated detent means for holding said arm in position relative to said base member.

2. The flashlight holding and positioning device of claim 1 wherein said means for pivoting said arm includes means for moving said arm around a vertical axis perpendicular to said base member.

3. The flashlight holding and positioning device of claim 1 wherein said means for pivoting said arm includes means for swiveling said arm with respect to said base member.

4. The flashlight holding and positioning device of claim 1 wherein said detent means includes a male detent member on said arm which is positioned relative to a female detent member on said base member to hold the arm at an angle with respect to said base member.

5. The flashlight holding and positioning device of claim 1 wherein said means for maintaining the relative position of said arm with respect to said base member includes a group of adjusting apertures on said base, an adjusting member pivotally attached to said arm including adjusting pins which engage said adjusting apertures for maintaining the relative position of said arm with respect to said base member.

6. The flashlight holding and positioning device of claim 1 wherein said means for maintaining the relative position of said arm with respect to said base member includes an adjusting slot formed in said base member, an adjusting member pivotally attached to said arm including an adjusting foot which is positioned in said adjusting slot for holding the relative position of said arm with respect to said base member.

7. The flashlight holding and positioning device of claim 6 wherein said adjusting foot is coated with material to provide friction between said adjusting foot and said slot formed in said base member.

8. The flashlight holding and positioning device of claim 1 wherein said means for securing a flashlight to said arm comprises a slot formed in said arm which is positioned to receive a hook and eye fastener therethrough for securing a flashlight to said arm.

9. The flashlight holding and positioning device of claim 1 wherein said means for securing a flashlight to said arm comprises a restraining band attached to said arm for securing said flashlight to said arm.

10. The flashlight holding and positioning device of claim 1 wherein said means for securing a flashlight to said arm comprises a restraining finger attached to and positioned on said arm for securing said flashlight to said arm.

11. The flashlight holding and positioning device of claim 1 including magnetic means affixed to said base member for holding said flashlight holding and positioning device on a metallic object.

12. The flashlight holding and positioning device of claim 1 wherein said arm includes a cradle member at one end thereof for accepting a head of said flashlight for supporting and directing the beam of said flashlight.

* * * * *